US005636844A

United States Patent [19]

de Buys

[11] Patent Number: 5,636,844

[45] Date of Patent: Jun. 10, 1997

[54] SIMULATED GOLF GAME

[76] Inventor: James W. de Buys, P.O. Box 13733, New Orleans, La. 70185

[21] Appl. No.: 279,094

[22] Filed: Jul. 22, 1994

[51] Int. Cl.[6] ..... A63B 67/02

[52] U.S. Cl. ..... 273/317.2; 473/162; 473/165; 473/172; 473/409

[58] Field of Search ..... 273/176 R, 176 A, 273/176 AA, 176 AB, 176 B, 176 D, 176 E, 176 F, 176 FA, 176 FB, 176 G, 176 H, 176 J, 176 K, 176 L, 3 AR, 177 R, 178 R, 180, 178 B, 181 R, 181 A; 206/315.1, 45.14; 229/120.23, 199; 220/410; 473/157–175, 317.2, 409

[56] References Cited

U.S. PATENT DOCUMENTS

| | | | |
|---|---|---|---|
| 2,090,780 | 8/1937 | Bonville | 229/199 |
| 2,766,048 | 10/1956 | Fortino | 273/176 F |
| 2,849,238 | 8/1958 | Eldredge . | |
| 3,027,163 | 3/1962 | Saatzer . | |
| 3,081,090 | 3/1963 | Congleton . | |
| 3,086,779 | 4/1963 | Taylor . | |
| 3,104,879 | 9/1963 | Jetton | 273/178 R |
| 3,190,657 | 6/1965 | Johnson . | |
| 3,434,721 | 3/1969 | Travers | 273/176 F |
| 3,610,631 | 10/1971 | Mulherin . | |
| 3,652,095 | 3/1972 | Furnari et al. . | |
| 3,671,042 | 6/1972 | Garber . | |
| 4,026,561 | 5/1977 | Baldorossi et al. . | |
| 4,157,831 | 6/1979 | Renn . | |
| 4,171,134 | 10/1979 | Reck . | |
| 4,275,886 | 6/1981 | Bannon . | |
| 4,577,867 | 3/1986 | Lenhart . | |
| 4,596,392 | 6/1986 | Walker . | |
| 4,660,834 | 4/1987 | Carrigan . | |
| 4,667,964 | 5/1987 | Hickey . | |
| 4,726,589 | 2/1988 | Grigas . | |
| 4,862,823 | 9/1989 | Hughes . | |
| 4,906,006 | 3/1990 | Sigunick . | |
| 4,988,105 | 1/1991 | Perry et al. . | |

*Primary Examiner*—Sebastiano Passaniti

*Attorney, Agent, or Firm*—C. Emmett Pugh; Pugh/Associates

[57] ABSTRACT

A simulated golf game including a substantially reduced size course in which each "hole" (10) and its respective tee marker (40) is separated from each other by a minimum of about fifty (50') feet and a maximum of about one hundred and fifty (150') feet for "holes" having pars "3" to "5" (FIG. 7), that can be played, for example, in the yard of the user, including regulation size balls (20) that are of relatively light weight; "holes" in the form of, for example, relatively large, outer diameter [e.g. twenty (20") inch] and relatively large, inner diameter [e.g. fifteen (15") inch] ramp rings (10, FIGS. 1A & 1B) substantially spaced about on the ground, each having an easy-entry/reluctant-exit hoop configuration; miniature flags (30, FIGS. 3A–C) associated with the "holes", and tee markers (FIGS. 4A–4D) and tees. The ball has an effective "maximum" range of about fifty (50') feet and is formed of an aerated, hollow, plastic hemisphere with a weight of about a tenth (0.1 oz) of an ounce. Detailed rules for the simulated game are disclosed. Innovative combined packaging for the game is included (FIGS. 5 & 6). The game is based largely on the conventional rules of golf, with the utilization of the above equipment, which allows for the playing of golf on a much smaller scale than has been traditionally pursued without losing its accuracy in simulation of the real game of golf.

14 Claims, 7 Drawing Sheets

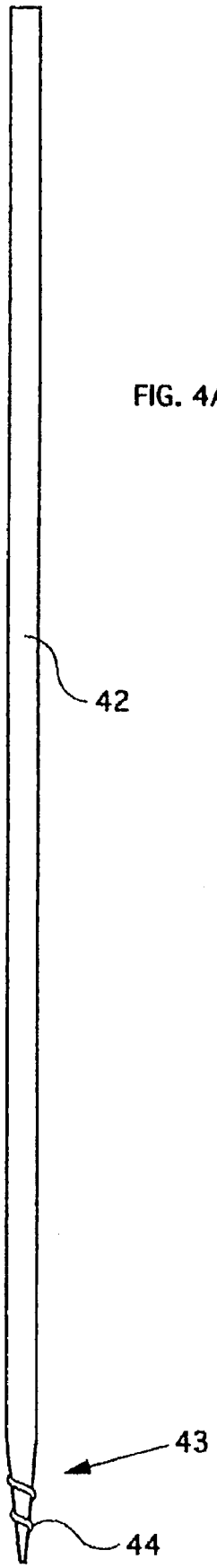
FIG. 4A
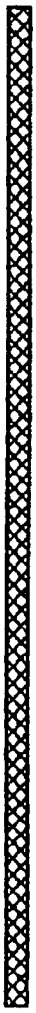
FIG. 4D
FIG. 4B
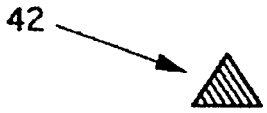
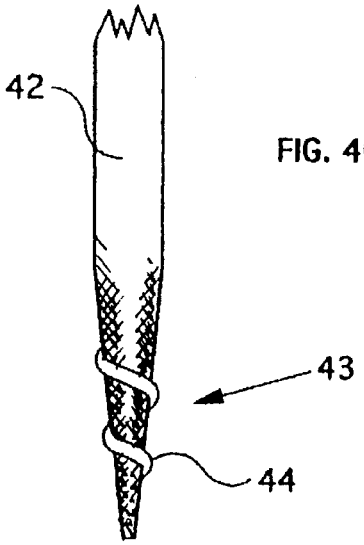
FIG. 4C

FIG. 5A
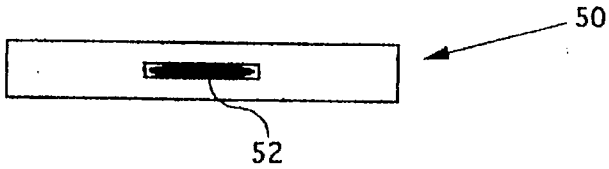
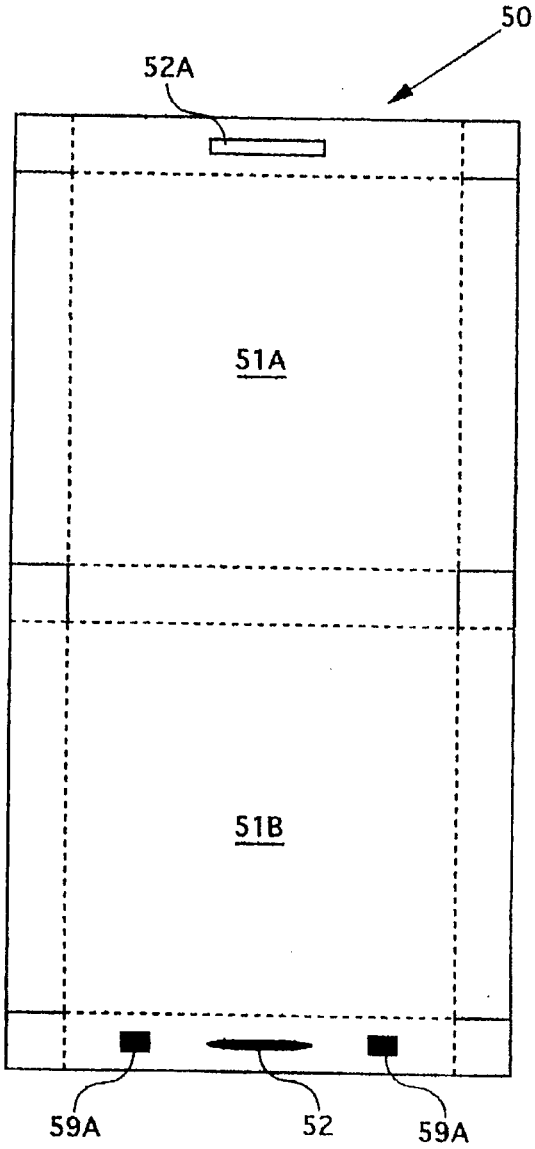
FIG. 5B
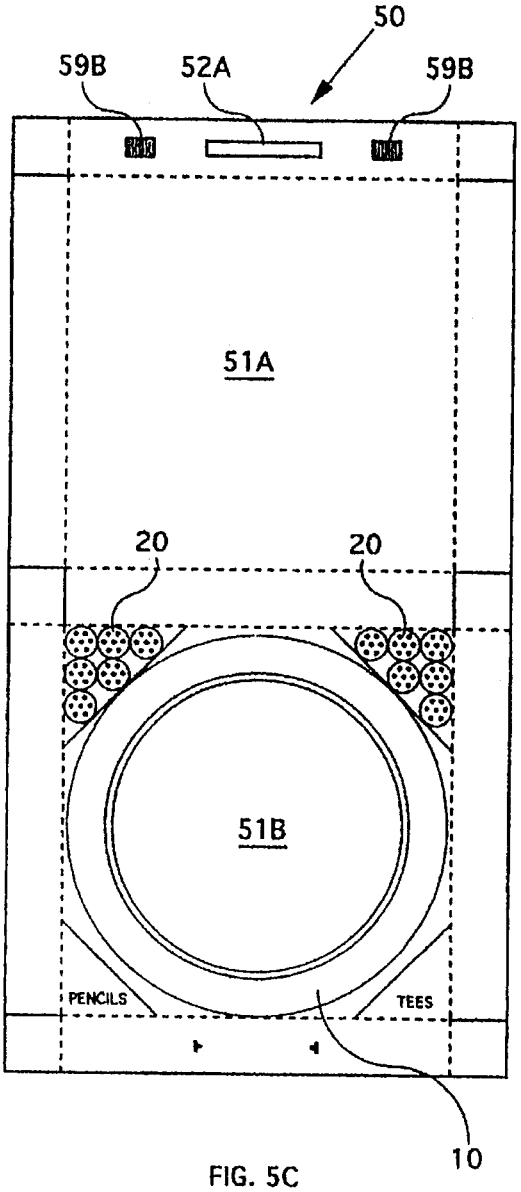
FIG. 5C

SIMULATED GOLF GAME

TECHNICAL FIELD

The present invention relates to games, and more particularly to a reduced size game which nonetheless closely simulates the game of golf, and to the packaging therefor.

BACKGROUND ART

As anyone who has ever had the urge or desire to play golf knows, first there must be a course available, then it has to be accessible for the time one wishes - and, of course, one must go to the course to play. These factors tend to limit and restrict golf play.

Such was the case some years ago when the inventor, living in the wilderness of the Ozark Mountains with no direct or immediate access to a golf course, found himself isolated from the game he so loved. Creating and maintaining a regulation golf course was out of the question, both from expense and time constraint considerations.

A shag bag provided some relief as the inventor whiled his spare time away practicing pitch and chip shots with regulation golf balls. The need for full-swing exercise led him to the nearby town of Berryville, Ark. where he purchased some hollow plastic golf practice balls. These provided an added degree of satisfaction in that he was able to at least swing fully at a golf-like ball and could gauge his efforts by the resultant flight patterns (hooks, draws, slices, fades, etc.). With this activity came target consciousness, because, where a ball comes to rest, is a key measure of the effectiveness of the swing. An inverted trash can top became an apt object to shoot for.

Noting the additional gratification accorded when a ball came to rest within the confines of the concave lid, the inventor was struck with the idea of laying out a miniature golf course, using available objects (can tops, lids, frisbees, etc.) for 'holes'. He determined the average distance a well-hit plastic ball traveled and applied this gauge to design "holes" with golf-like pars of 3, 4 and 5.

The irregularity of the available receptacles soon led the inventor to fashion rope rings set initially to the size of the original trash can top. After much experimentation he deduced an opening size that would parallel in effectiveness the golf hole.

Once the "right" opening was determined, the inventor found that a ramp-like incline more readily received a rolled ball and made a wood mold for vacuum forming a plastic ring. After much experimentation with different types and thicknesses of plastic and many mold design adjustments, the ring presented here was developed.

As the game of the invention took on an identity of its own, a special set of rules was necessary to differentiate from and augment "The Rules of Golf." (The rules of the preferred embodiment of the game of the invention are presented below.)

The frivolous, non-serious nature of the invention lends itself to the invention and play of variations on the golfing theme not normally condoned or allowed in golf. Along with the special rules, the inventor discovered, devised or derived from his golfing experience a number of different types of golfing games. (These unique games of the invention are listed and explained in this specification.)

The following quotes provide further background to the present invention.

"The royal and ancient game of golf is one of the oldest of our modern sports. Some historians tell us that the sport had its origin with the idle antics of shepherd boys knocking small stones into crude holes in the ground with a crook, while their flocks grazed lazily in nearby fields. It is known, however, that the Romans, in their day of empire, played a game called 'paganica', which involved the use of open countryside, a bent stick, and a ball stuffed with feathers. As the Roman empire included Europe and parts of England and Scotland, it is therefore assumed by most historians that the game of 'paganica', with its feather ball, was the forerunner of golf."

"The sport as played in the fifteenth century by the Scots was still played with rather crude equipment: a leather bag stuffed with feathers for a ball and a club cut from a bent tree branch. Nor did they have any set golf courses."

"Until the middle of the eighteenth century golf had been played over courses of no established length (and no predetermined number of holes)."[GOLF MAGAZINE'S ENCYCLOPEDIA OF GOLF (©1970).]

The game of the invention is a return to the roots of golf. It uses a ball that, like the "featherie" of long ago, has a rather limited distance capability.

In the preferred embodiment of the invention the use of one club throughout the course of playing a round is in keeping with the earliest tradition of golf. And, the game of the invention can be readily played and enjoyed on courses of "no established length or predetermined number of holes".

A listing of prior patents, which may be relevant to the invention, is presented below:

| Patent No. | Patentee(s) | Issue Date |
|---|---|---|
| 2,849,238 | Eldredge | 08/26/58 |
| 3,027,163 | Saatzer | 03/27/62 |
| 3,081,090 | Congleton | 03/12/63 |
| 3,086,779 | Taylor | 04/23/63 |
| 3,190,657 | Johnson | 06/22/65 |
| 3,610,631 | Mulherin | 10/05/71 |
| 3,652,095 | Funari et al | 03/28/72 |
| 3,671,042 | Garber | 06/20/72 |
| 4,026,561 | Baldorossi et al | 05/31/77 |
| 4,157,831 | Renn | 06/12/79 |
| 4,171,134 | Reck | 10/16/79 |
| 4,275,886 | Bannon | 06/30/81 |
| 4,577,867 | Lenhart | 03/25/86 |
| 4,596,392 | Walker | 06/24/86 |
| 4,660,834 | Carrigan | 04/28/87 |
| 4,667,964 | Hickey | 05/26/87 |
| 4,726,589 | Grigas | 02/23/88 |
| 4,862,823 | Hughes | 09/05/89 |
| 4,906,006 | Sigunick | 03/06/90 |
| 4,988,105 | Perry et al | 01/29/91 |

As may be seen by a review of the above listed patents, there exists multiple patents, from as early as at least 1958, teaching in a broad sense miniaturized aspects of golf simulation games and the like.

For example, U.S. Pat. No. 2,849,238, issued in 1958 to Eldredge discloses a "golf putting practice device" which uses golf "practice" balls and a boxed "hole" with miniaturized flag indicia for marking the hole. As noted, this is a putting practice system in which balls are hit to roll across a surface. There is no attempt to provide a full golf course simulation with balls being driven up in the air substantial distances, e.g. of the order of about fifty (50') feet, as in the present invention with Eldredge's putting practice being only one very limited aspect of the game.

U.S. Pat. No. 3,027,163 issued in 1962 to Saatzer teaches a "lawn golf game" wherein there is included a "hole"

comprising bunkers having varying configurations for their top openings, which are relatively small in their central opening "diameters", the over-all, outer diameter itself being only twelve (12") with the ball's diameter (four inches) basically filling up the inner diameter (see FIG. 7), and into which the balls are to be hit, with the "par" of each hole being determined by how large vs. how small the entry opening is. Indeed, in view of the relatively small and complexly shaped openings for the "hole" bunkers, it is considered easier to loft the ball (obviously from only a relatively short distance) into the central opening than to try to cause the ball to roll up the surface into the opening which is considered "extremely difficult". This is in contrast to the invention in which most holes will be made by causing the ball to roll up the sides of the relatively easy entry, ramped rings, which have relatively large diameters (about 16" with an exemplary outer diameter of 20"), a sixty-six (66%) percent increase in size in comparison to the bunkers of Saatzer.

U.S. Pat. No. 3,081,090 issued in 1963 to Congleton is directed to an "indoor, outdoor golf game" using inter alia wicker mats having holes at either end and cup pad holes, the latter being circular with an outer diameter of twelve (12") inches, with a central opening of apparently only about two and a half (2.5") inches, in connection with which a ball having a three (3") inch diameter is used, with the pad having a maximum thickness of only an eighth (⅛") of inch to a minimum thickness at its outer edges of only one-thirty-second (1/32") of an inch. Thus, the ball is larger in its diameter than the opening in the cup pad hole, which is nearly flat and would not be suitable for the "hole"-simulation, relatively large diameter, reversely sloped, ramp ring used in the present invention. This almost flat, small, cup pad hole of Congleton, like the other references, again is totally different in approach and use to that of the present invention.

U.S. Pat. No. 3,086,779 issued in 1963 to Taylor discloses a "simulated golf cup, which is comprised of a disc used to "practice putting, approach shots and the like."

U.S. Pat. No. 3,190,657 issued in 1963 to Johnson discloses an "inflatable golf practice target" wherein there is included an extremely large, inflatable toms, which is raised up off of the ground and into which balls are lofted to practice "chip" and "pitch" shots. The diameter of the exemplary embodiment of the toms, which is similar to a very large "inner tube" for a tire, is on the order of three feet in diameter and so designed to train the user to get within about three feet of the actual hole. The Johnson device is thus not a simulation of a golf hole and teaches away from the present invention.

U.S. Pat. No. 3,610,631 issued in 1971 to Mulherin teaches a "golfing target" game package comprising a cup-type hole having a series of radiating, dissimilar ramps with varying physical obstacles formed on them, a set of golf clubs and practice golf balls, tees and score pads.

U.S. Pat. No. 3,652,095 issued in 1972 to Fumari et al teaches a golf game apparatus wherein there is included whiffle balls and a series of horizontally disposed, cylindrical receptacles for the balls and having miniature hole markers incorporated therewith. Because of the nature of the horizontal disposition of the receptacles, they can only be putted into and are not suitable to simulate golf "holes".

U.S. Pat. No. 4,026,561 issued in 1977 to Baldorossi et al uses a relatively large ball having a diameter of five (5") inches of light weight foam construction with clubs having "a surface area approximately 2.8 times larger than the faces of regulation golf clubs". Baldorossi in FIG. 14 and at the top of column 7 describes the use of a portable ball trap for putting practice, which trap includes a base and an outer ring with a series of independent, inwardly and upwardly directed, flexible tines which bend down to allow a ball to enter and then flex back up entrapping the ball within the trap. After a period of time and substantial flexing, such tines have a tendency to weaken and be broken off. Additionally, the tines extend up to a relatively great height, making it more bulky and not as accurate in its golf simulation aspects as the present invention. This patent also teaches away from the present invention by requiring the use of non-regulation clubs having substantially enlarged faces in conjunction with a ball having twice the volume and size of a regulation golf ball, with all of the various size clubs being used in the game, with the typical club strokes for the various clubs providing average ranges (note table of FIG. 13) from 15–25 yards (i.e., 45–75'; wedge club) to 40–55 yards (i.e., 120–165'; #1 club).

FIGS. 1–4 of U.S. Pat. No. 4,171,134 issued in 1979 to Reck illustrate a golf game wherein there is included a series of lesser and lesser diameter wire hoops or annuli, associated together in a spiraling manner, culminating in an inner-most, ramped one which corresponds to the hole in the traditional game of golf, using a "whiffle" type ball and a golf flag assembly. It is surmised that the size of the inner-most cup is of the same size as an actual golf hole, namely about four and a quarter (4.25") inches in diameter, the latter having a depth of about four (4") inches.

U.S. Pat. No. 4,577,867 issued in 1986 to Lenhart is directed to a "short flight golf ball and game" comprising a course having a single hole with multiple approaches designed to be played in the backyard of the user, in which a foam body ball of regulation size and a conventional cup for the hole is used.

U.S. Pat. No. 4,906,006 issued in 1990 to Sigunick discloses a putting and chipping practice golf device comprising an inclined base having a cup opening into which a series of concentric ring members of varying diameters are inserted or removed to alter the effective size of the cup opening and apparently no dimensions are suggested. The approach of this patent is directed to a single such device used by one or many users for practice shots.

The other, above listed prior patents, which are not specifically discussed above, are believed not to be as relevant as those discussed above in some detail. However, they should likewise be reviewed for further background information and understanding.

It is noted that none of the foregoing prior patents, either singularly or in any appropriate combination, suggest or teach the very accurately simulating game of golf of the present invention, with all of the invention's advantages and innovations.

General Discussion of Invention

The present invention is directed to an accurate golf simulation system which when laid out is of a size much smaller than a regular golf course and can be played, for example, in the yard of the user, which system or simulation game includes:

multiple, spaced "holes" in the form of relatively low height, ramp rings with central openings having relative large, outer diameters [e.g. about twenty (20") inches] and relatively large, inner diameters [e.g. about fifteen (15") inches], which ramp rings are placed on the ground spaced substantially apart, with each having an easy-entry/reluctant-exit, oppositely ramped configuration which allows the relative easy entry of the ball into it when the ball is rolled into it but resists the ball's exit when it attempts to roll out;

a simulated golf ball of relatively light weight having an effective "maximum" range of about fifty (50') feet but preferably of a diameter at least comparable, if not equal, to that of the regulation golf ball;

preferably with a series of miniature, color-coded flags associated with the "hole"-simulating, ramp rings, with the flag colors being coded to the par value assigned to the particular "hole", along with tee markers and preferably tees;

with each tee marker preferably spaced from its respective "hole"-simulating, ramp ring an effective "minimum" of about fifty (50') feet to simulate, for example, a "3" par hole, and a typical "maximum" of about one hundred and fifty (150') feet to simulate, for example, a "5" par hole, with the tee marker also being preferably color coded to the hole's par value; and preferably with the use of a single type of standard golf club, in which the club is used with a full swing, providing for the majority of the strokes in the game with resulting airborne balls, during the playing of the game, with a putting stroke at least generally not being used.

It should be understood that a substantial amount of flexibility is present in the game of the present invention, and, although it is possible to get some of the benefits of the present invention using, for example, a single ramp ring for play, the more valuable, essence of the invention is obtainable by including at least three "hole"-simulating ramp rings (and preferably more) spaced about with respect to their respective tee markers an effective minimum of about fifty (50') feet to simulate at least two different pars selected from the group consisting of pars "3", "4" & "5", or a minimum of about thirty-five (35') feet if a "2" par hole is desired.

With respect to the golf club, the preferred embodiment of the present invention contemplates using a pitching wedge or short iron, e.g., a number iron, as the single golf club to be used throughout the game, with the tees being those used in regulation golf; while the relatively large diameter, "hole"-simulating rings preferably each have a non-ground piercing underside with opposed inclined or sloped surfaces, an outer, easy-entry one and an inner, reluctant-exit one, forming a non-symmetrical, inverted-"V"-shaped cross-section, allowing the rings to be easily stacked one on top of another for storage and packaging. The term "regulation" as used herein refers to the rules and regulations of the United States Golf Association and The Royal and Ancient Golf Club of St. Andrews, Scotland.

The preferred game itself is based largely on the conventional rules of golf, with the utilization of the above equipment which would allow for the playing of golf on a much smaller scale than has been traditionally pursued without losing its accuracy in simulation of the real game of golf, with the desired exception of putting to eliminate the special course (smooth surface) requirements putting demands.

As further background, it is noted that the game of golf is one of the most exciting, compelling, intriguing, comprehensive, demanding, and, ultimately, satisfying sports available to mankind. However, as suitable and desirable as it is to play, it is one of the least accessible. The building of a golf course takes a considerable investment of time, money and, especially, space to create and maintain.

Thus, there are relatively few courses available. Additionally, to play, one has to go to the courses, which are few and far between.

Then there is the playing time factor. It takes about four to five (4–5) hours to play an eighteen (18) hole round of golf, a major time allotment and scheduling consideration for most people.

In contrast, the game of the present invention offers a very desirable alternative. It provides access to the essence of golf for the masses who for whatever reasons (be they physical, economic, logistical or lack of proper exposure) haven't been able to connect with regulation golf. It brings the game to the people on a scale and level they can relate to and realize, while taking a fraction (e.g. a half hour or less) of the time to play.

Where regulation golf demands a rather large area of manicured land to play properly [e.g. one hundred and sixty (160) acres or so for eighteen (18) holes], the game of the present invention can be set up in a relatively small space [e.g. less than two (2) acres for eighteen (18) holes] on almost any surface.

Playing with the preferred aerated, hollow, plastic ball of the invention with rather limited distance capability, the game of the invention allows the participant to place the course where it can be most accessible. In fact, in the game of the invention the simulated course can be set up wherever and whenever one wants.

Thus, the game of the present invention provides a reduced-scale golfing experience played with, if so desired, one or more standard golf clubs ("short" irons), hollow, aerated plastic balls and a ramped ring (in place of an actual hole down in the ground).

The invention thus provides or is played on a transportable, miniature, golf-like course. It, in effect, brings the game of golf to the player(s), rather than requiring golfers to go to an existing course as in regulation golf play.

It can even be played indoors in dedicated room/space (basketball gyms, halls, warehouses, office buildings, etc.). The layout of the indoor game of the invention uses, for example, netting dividers between "holes" and portable mats (for example, 6.7"×20') or special three-pronged tees (for play on hard surfaces).

The game of the invention is readily available to everyone. It is a game that can finally give all who chose to play an opportunity to enjoy the essence of one of the truly great game experiences available in all of sport . . . golf.

Some of the major differences that distinguish the game of the invention from regulation golf lie in the size of the course, the configuration of the ball and the use of an appropriate ring as a substitute for the regulation hole.

Basically, the game of the invention offers the essential golfing experience to all people. And, what's most important is the fact that the game of the invention is FUN!

GENERAL SUMMARY OF ADVANTAGES/ DISTINCTIONS

In further summary, some of the advantages and distinctions of the present invention over the prior art are outlined below.

"Full Swing" Golfing Experience

The preferred embodiment of the invention utilizes total Golf game action, including tee, fairway, approach & recovery shots; pitches; chips; etc. It simulates Golf in every way (except putting). It also parallels regulation Golf situations.

The invention facilitates controlled ball flight since little effort is required to manipulate the aerated, lightweight ball, allowing for hooks, draws, slices, fades, etc.

Play

As many people can play as want to at any time (allowing for gangsomes, etc.), and no tee time reservations are required. The preferred embodiment uses regulation Golf equipment, including clubs and tee, as well as using a Golf size and shape ball.

Playing Time

A round of the game of the present invention can easily be played in less than a half an hour, whereas a round of GOLF takes 4–5 hours.

Course Maintenance

The grounds upon which the game of the present invention can be played takes little energy and is easy to maintain. Usually (as in original Golf) the course is laid out on available land and adapted to existing terrain, so no ground preparation is necessary.

On a home course a minimal amount of grass cutting needs to be done to suit a layout (particularly around the "hole-simulating" ring of the invention).

If the grass is allowed to grow, playing in tall grass is still stimulating and fun.

Low Cost To Play

The cost of buying the game is typically the only cost, and that cost is quite reasonable. There are no green fees. Thus, one can play as often as one desires —for essentially no cost, yet still enjoy the full spectrum of playing a golf-like game.

Regulation Golf Equipment

The preferred embodiment of the present invention use regulation equipment —except for the ball which conforms in size and shape to the regulation golf ball.

Portability

The elements needed to create the invention's course goes with the player, rather than the player going to the course.

Flexibility/Variety

The ease of laying out a course of the type of the present invention lends itself to setting up new courses at the player's behest. One can play as many different courses as s/he cares to lay out.

Creativity

The present invention allows a player to be more creative on shotmaking, since little effort is required to manipulate the lightweight ball; and the availability of a course of the type of the present invention leads to more frequent play, thus giving the player more opportunity to experiment.

* * *

The foregoing advantages and distinctions over the prior art, as well as additional ones, are discussed more fully below.

SOCIAL ASPECT

Additionally, the game of the invention is a very social game. Since not much space is required [the exemplary ball only has an effective "maximum" range of about fifty (50') feet (when struck by an expert golfer)], players are never too far away from each other and conversant interaction is relatively effortless. Players are always near enough to the other participants to engage easily —and disarmingly —with one another. Because of this closeness during the course of play, it's easier to share common energy with co-players. In fact, there is an inherent party aspect. Since there is no limit to the number of players allowed in a group, the game invites gangsomes and can take on the atmosphere of moving party.

And, unlike golf, the hollow plastic practice balls used in the preferred embodiment of the game of the invention are so light and air resistant/sensitive that they pose virtually no harmful threat to other players and observers.

HEALTH ASPECT

Stress Release

" . . . certain kinds of psychosis come from a lack of proper exercise. Better games would empty entire wings of (our) mental hospitals." [GOLF IN THE KINGDOM (Michael Murphy, 1972).]

According to medical and health authorities, stress is the major cause of physical ailments in the U.S. or maybe in the world today. Golf is well known to be a prime activity for stress release. As in golf, the game of the present invention provides a person with a self-determined activity that, when properly played, can serve to alleviate stress in the participant.

The ready availability of the game of the invention makes it a positive tool for therapy: mental, emotional and physical. One can go out and play a round whenever one is stressed, wherever one wants to play.

The game of the present invention, like golf, provides immediate gratification and positive reinforcement —one gets in mode of making good shots; going for good swing, score, etc. It's a fun exercise that gets the body moving.

Then there is the laughter factor. Levity is a very well known remedy for alleviating stress from the human condition. Since the game of the invention is such a social game, with players always in close proximity to each other, the interactive atmosphere lends itself to relaxed exchanges and unguarded openness. One can attempt extremely difficult or even crazy shots and laugh at a failed result while learning from the experience. The game of the invention is so simple and easy that the Ego (particularly the "real" golfer's ego) is diminished/reduced/balanced and one is thus more open and apt to laugh at one's miss-hits/errors. It is an emotional releaser and attitude adjuster all in one. Fun is the common denominator.

It is very important for people to detach, disengage their consumptive concerns from the lives they lead. One of the best "washes" available is the golfing experience. It serves to . . . free the Spirit.

Exercise

In an age where sedentary behavior is more prevalent than at any time in our history, it usually takes entertainment or sports to get most people up and active.

Walking is known to be a most positive form of exercise. The game of the invention, like golf, provides the player with the opportunity to walk a lot.

As all golfers (and most physical therapists) know, the golf swing is an ideal exercise for maintaining flexibility in the body. Every muscle, tendon, joint and bone is used in the swing.

Also, during play, walking and swinging the golf club serve to get the heart pumping and the blood moving.

Elderly People (Senior Citizens)

Many golfers have to give up playing the sport they love because of the physical limitations of old age. They do not have either the strength or flexibility to play. With the game of the invention, they once again can have the opportunity to experience the flavor of golf.

Additionally, those who have never before been exposed to golf, for whatever reasons, can take up the sport through the game of the invention. Many are in search of, perhaps even a need for, such a gentle, outdoor activity to maintain their health. By playing the game of the invention, they can now glean essential benefits and experiences of the game of golf.

Physically Impaired

For those who do not have or never had the physical capability to play golf, the game of the invention can provide the opportunity to experience many of the most positive aspects of the game.

Among the beneficiaries are those confined to wheelchairs, the disabled, those recovering from operations or undergoing treatments (chemotherapy, physical rehabilitation, etc.), arthritics and others afflicted with joint problems . . . etc.

The game of the invention also is a positive activity for recovering addicts.

Office Workers & Computer Hackers

As people get more and more into computer use, the need for "break-away" activities is readily apparent. Eyes need rest and refocusing, backs need flexing, lungs need airing and brains need "washing". The game of the invention gives a quick-fix in a very entertaining, as well as healing, manner. On the preferred courses of the invention, eyes embrace/focus on non-artificially lighted, natural images, most often bathed in the healing color —green. The golf swing frees up the body which has been locked into a desk/office setting. Being out-of-doors brings fresh air to needy lungs. And, the golfing experience, being so all-involving and consuming, washes all congestion out of the brain while the inherent excitement of the game gets the heart pumping. All of this is available to anyone with a few minutes of "break" time.

APPLICATIONS/USES OF THE PRESENT INVENTION

Schools

Quite often "physical education" curriculums offer golf classes but have no access to golf courses. They can teach the swing and other essential information to the student but have no facility to show how to apply this instruction to the game itself. They leave it up to the student to go to the course and complete the learning experience.

Since the exemplary course of the present invention can be set up quickly in very little space at the school, teachers of Phys. Ed. classes can use the game of the invention to teach students some of the hands-on applications of golf (such as course management; scoring; chipping; pitching; full-swing short irons; attitude; emotional control; etc.). Additionally, by involving the student in laying out the course of the invention, an opportunity to understand golf course design/architecture is presented.

Inner-City (Projects & Ghettos)

The game of the invention can be set up in playgrounds and, with special tees (or portable tee mats) and rings, can even be played on cement and asphalt. The type of competition that is engaged is more of an individual nature and therefore reinforcing of the "self" than most any other sport. In a time of gang mentality in the inner cities and the feelings of ennui and insecurity in the individual, a game like golf would be beneficial to the atmosphere of the community. Since golf is basically inaccessible to these people, a reduced-scale version of the invention could serve to reach them.

Clinics, like those given by Calvin Peete (PGA teaching and former touting pro), could have an added dimension by reaching people who could not get to a regular golf course or driving range.

Prisons

The game of the invention would provide a positive activity for prisoners, taking up little space, while providing non-violent, self-reinforcing, and enhanced self-worth in a sporting environment.

Military

The game of the invention is ideal for military bases and solitary outposts. It can give some peace of mind and detachment, while occupying idle minds with positive application. Plus, the game could easily be set up —and quickly taken down. (What a boon the game of the invention would have been in the Arabian deserts in the Iraqi conflict.)

INDOOR VERSION OF THE INVENTION

As generally noted above, the game of the invention can be played indoors in, for further example, dedicated interiors (basketball gyms, halls, warehouses, office space, specially designed buildings incorporating special versions of the invention, etc.). A large room can be converted for use of the invention by placing netting dividers between holes, an artificial-turf playing surface laid throughout (with plants, hazards and other obstructions installed) or using portable tee mats or special three pronged tees (for play on hard surfaces). It is noted that the indoor course design aspect changes primarily in the distance factor, as the ball will have considerably more roll on hard, smooth surfaces.

HOW THE INVENTION IS GOOD FOR GOLF

Introduction to Golf

Inasmuch as the preferred embodiment of the invention provides a reduced-scale variation of the golf theme, playing it introduces participants simply and easily to regulation golf.

The low-key aspect of the game of the invention tends to invite participation (play) by the tentative. Those concerned about being embarrassed by their initial ineptitude in playing regulation golf will find no such problem in the preferred embodiment of the invention. Even the least capable golfer can have early, relative successes in the invention and, regardless of their lack of proficiency, can have fun from the start.

The game of the invention is also a great teaching aide to impart the basics of golf to the very young. Since the major impediments to kids playing golf (physical effort required to move "heavy" golf ball around a large expanse of land) are eliminated, they tend to sustain their interest and attention longer.

Etiquette

The USGA Rules of golf booklet begins with a section on etiquette. There is good reason for this. How players relate to the golf course and to each other is a very important aspect of the game.

The game of the invention is a wonderful experience for teaching proper golf etiquette. Since all players remain in such close proximity while playing the small course of the invention, social interaction is both natural and easy. Players soon find that care for the course and courtesy toward each other are key considerations in the continuing enjoyment of the game.

Spreading Word of Golf

The invention embraces and supports the highest principles of golf. Every phase of the invention is designed to lead people on into the greater game of golf. From the Rules to the tools, the preferred embodiment of the invention is true to the nature of golf.

There are 28,000,000+ golfers in the U.S. today and not enough courses to allow for the growth potential of the game. The present invention offers opportunity to those who either can not access or afford to play a regulation golf course. If their interest is sufficiently stimulated through playing the game of the invention, they will continue it on in the playing of golf.

By its nature, the invention is a simple and easy way to introduce people to golf.

Teaching Aid

The preferred embodiment of the invention is a portable "facility" for teaching basics (essence) of golf to beginners. Many Phys. Ed. golf classes are given in schools where the students never get to experience the actual playing of the game. What the invention can do is bring the game to the student; to the campus in many cases.

Short Game

An essential aspect of the preferred embodiment of the invention is to utilize and develop the short game. With the "hole" finished off by pitching or chipping to a ring, the least practiced and most important element of scoring is attended to.

Course Management

By designing holes and laying out a course one readily develops proper course management —thinking and positioning one's way around a course as the game is being played. Real-life golf situations are encountered and dealt with, so, when met on a regulation golf course, they pose less of a problem.

Game Focus & Attitude

By playing the game of the invention, one naturally assumes and develops a game posture which relates directly in parallel fashion to golf.

Confidence Builder

The invention instills in the player a "go-for-the-pin" attitude which crosses over into regulation golf play.

Swing Enhancement

Swing repetition factor —the more you swing the easier it is to stay in the (swing) groove. The invention encourages a smooth easy swing because not as much effort needed to advance (move) the ball as is required with a regular golf ball. This factor translates to the regular golf swing, since the swing is essentially the same.

Zen Aspect

A most important aspect to maximized golf effort is becoming "one" with the target (destination of ball). For best results, the last thought one must have (and sustain) before starting the swing is a picture/image of where the ball should come to rest. By having the game of the invention so readily available, the player has a tendency to play more "holes" than s/he normally would, given the relative inaccessibility of a regulation golf course. This increased activity means more opportunity to practice this key element which, in turn, translates directly to better golf performance.

OBJECTS

It is thus the basic object of the present invention to provide a readily available, reduced size, simulated game of golf having multiple "holes" which, although much more compact in the size of the course and using a much lighter ball, accurately simulates the playing of the actual game of golf.

Another object of the present invention is to provide a simulated game of golf in which one or more of the following advantages are provided —beneficial social and health aspects, including for the latter, stress relief, good exercise, special benefits for elderly people and the physically impaired, office workers and computer hackers, etc.

Additional objects are to provide an accurately simulated game of golf which is capable of broad and varied applications (including use in schools, inner-city projects and ghettos, prisons, military installations, etc.), with the game being playable both indoors and outdoors, and being good for the game of actual golf itself.

It is a further, independent object of the invention to provide innovative packaging for the game which allows its elements to be attractively displayed, with the parts of the game of the invention readily available and organized for use.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers, and wherein:

FIGS. 4A, 4B and 4C comprise a side view, a horizontal cross-section view and a close-up detail view, respectively, of the exemplary tee marker (with the latter view just showing the bottom, threaded tip of the shaft of the tee marker) used to mark the staring point for each "hole" in the exemplary embodiment of the simulated golf game of the present invention; while FIG. 4D is a side view of an exemplary tassel used on the shaft of FIGS. 4A–4C.

FIGS. 5A, 5B and 5C are front, bottom and plan views, respectively, of an exemplary, preferred packaging box for packaging and storing the game elements of the exemplary embodiment of the simulated golf game of the present invention shown in the foregoing figures, with FIG. 5C showing the preferred, exemplary placement of the balls, rings, pencils and tees of the simulated game.

FIGS. 6A, 6B and 6C is a front, perspective, exploded view, a front, perspective, assembled view and a plan view, respectively, of the exemplary, preferred packaging box of FIGS. 5A–5C; while

MODES FOR CARRYING OUT THE INVENTION

Figure 7:
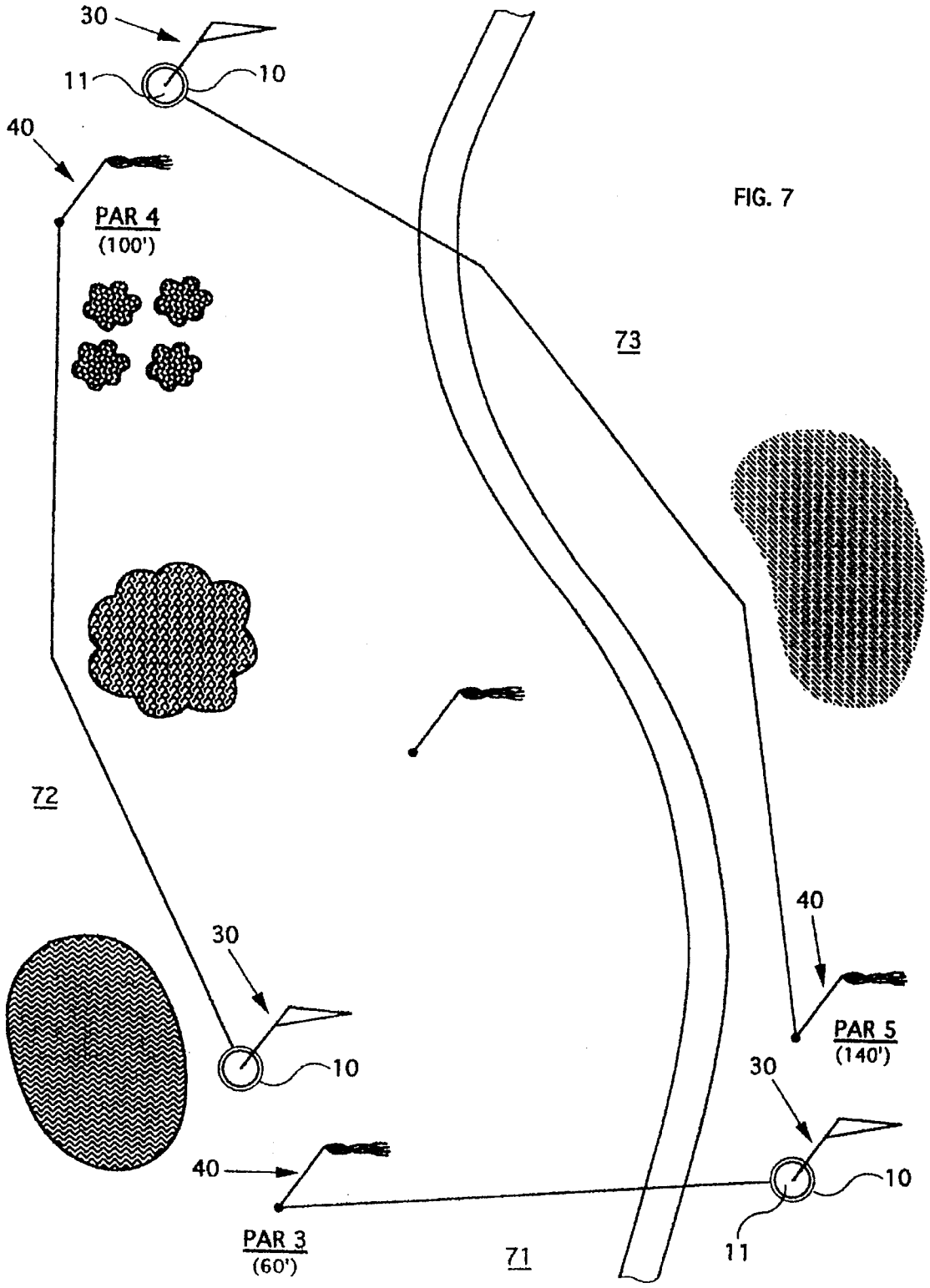
FIG. 7 is a generalized, plan view of an exemplary course layout for the preferred, exemplary golf simulation game of the present invention, showing an exemplary, basic three hole course, showing the relative spacing of the tee markers of FIGS. 4A–4D and the associated rings of FIGS. 1A & 1B and their respective flagsticks or flag-staffs of FIGS. 5A–5C, very accurately simulating a three par, a five par and a four par set of holes of real golf.

The exemplary, preferred embodiment of the simulated golf game of the present invention includes a series of ramp rings 10 (FIGS. 1A & 1B) having open centers which simulate "holes"; a relatively light-weight ball 20 (FIG. 2) with a relatively small range; a series of related flagsticks or flag-staffs 30 (FIGS. 3A–3C) to mark the "holes"; and a series of related tee markers 40 (FIGS. 4A–4D) to mark the starting areas for each "hole". The rings 20, flagsticks 30 and tee markers 40 are all laid out in an appropriate course, in which each tee marker is spaced from its respective "hole" (and hence its respective flagstick or staff) a "minimum" of about fifty (50') feet to a "maximum" of about one hundred and fifty (150') feet for par "3" to par "5" holes, and an exemplary course is illustrated in FIG. 7. A standard type golf club, for example, a #9 iron, preferably is used to hit the ball placed, for example, on a regulation or standard tee positioned on the course.

For a better understanding of the principles and use of the preferred embodiment of the present invention, the rules and details of the preferred embodiment of the golf simulation game will be described below.

RULES

It should be noted that, unless specifically defined under The Rules of the exemplary embodiment of the game of the invention outlined herein, the rules of regulation golf, as defined in The Rules of Golf approved by the United States Golf Association and The Royal and Ancient Golf Club of St. Andrews, Scotland, shall apply in the preferred embodiment of the game of the invention.

Figure 1B:
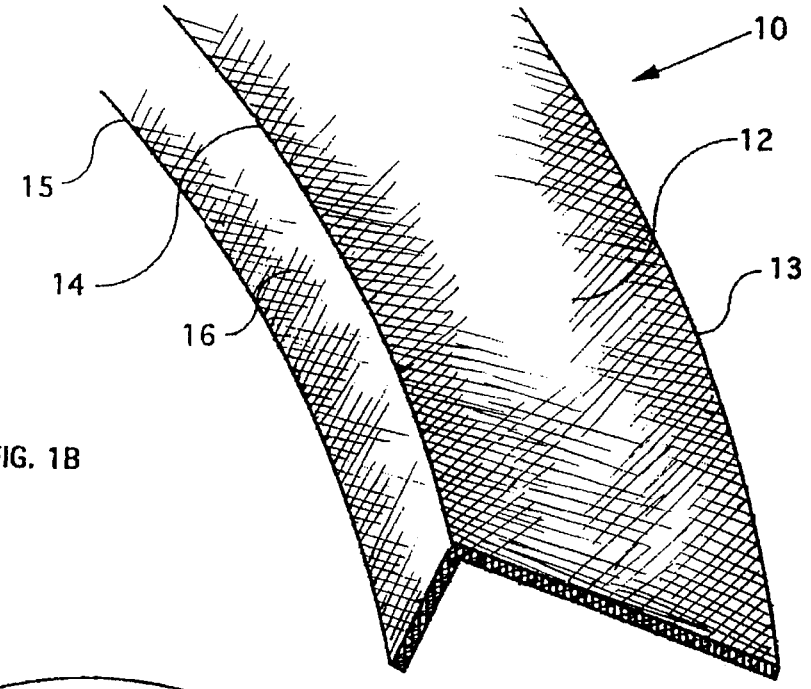
FIGS. 1A & 1B comprise a plan view and a side, cross-sectional and partially perspective view, respectively, of an exemplary embodiment of a ring used to simulate a "hole" in the exemplary embodiment of the simulated golf game of the present invention.
Figure 1A:
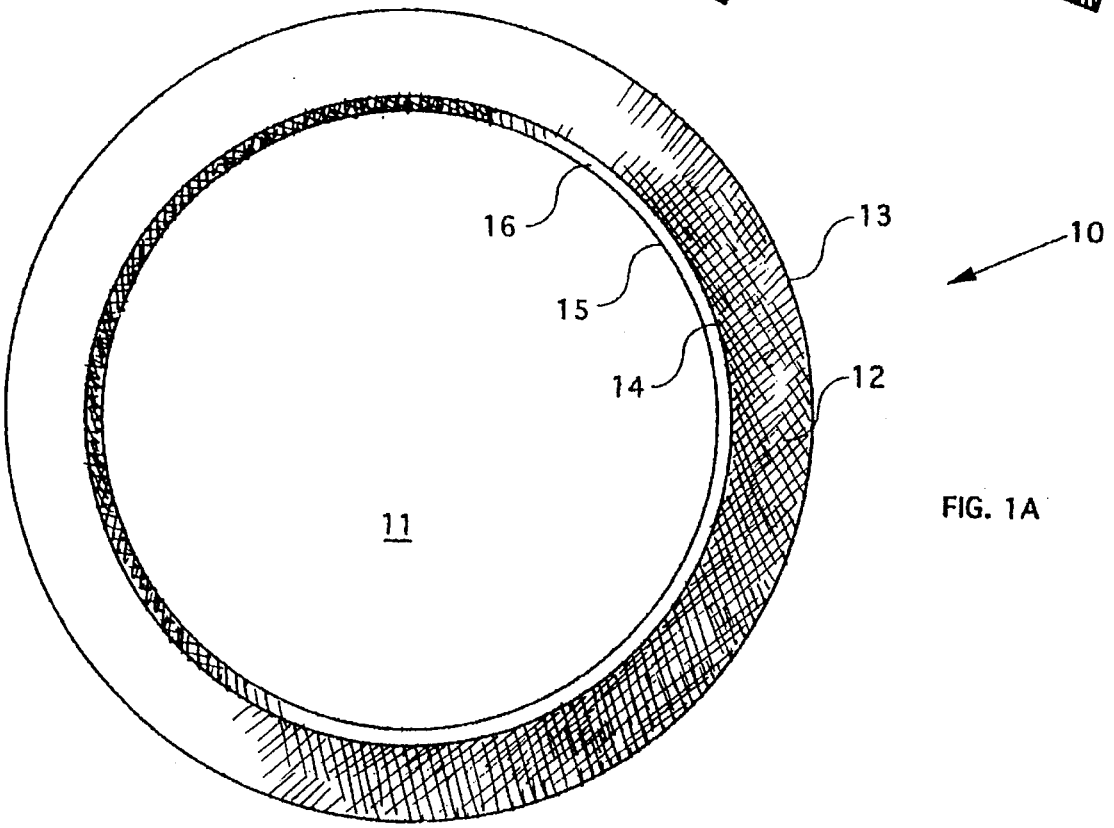

Ring (FIGS. 1A & 1B)

The exemplary embodiment of the ramp ring 10 (made of, for example, injection-molded or vacuum-molded plastic, wood, composite, etc.) has a relatively large outer diameter [e.g. about twenty (20") inches] and a relatively large inner diameter [e.g. about fifteen and a quarter (15.25") inches]. This defines a relatively large, open, central area 11, in comparison to, for example, the diameter of a regulation golf hole [typically four and a quarter (4.25") inch].

As can be seen in the drawings, the ramp ring 10 has an outside slope 12 (e.g. 2" wide) on, for example, a twenty (20°) degree angle, rising from the outer edge 13 (e.g. 20" dia.) of the ring to a height of, for example, three quarters (0.75") inch at the crown/apex 14 (e.g. 16" dia.) and descending at, for example, about a sixty-four (64°) degree angle, an appropriate distance (e.g. 0.875") to an inner diameter edge 15 of, for example, fifteen and a quarter (15.25" inches, producing a relatively low peak height above the ground of three-quarters (0.75") of an inch. Thus, the ring 10 presents a two (2") inch wide, ramp-like incline rising from the outer edge 13 at ground level at, for example, a twenty (20°) degree angle to a peak/ridge 14 of, for example, three-quarters (0.75") inch high, and descending at, for example, a sixty-four (64°) degree angle 0.875 inch to its inner edge 15 at ground level, with an exemplary thickness of 0.0625" (62.5 mil).

It is thus noted that each of the rings 10 is circular and has a sloping wall 12 going up on its outer periphery 13 and a sloping wall 16 going down on its inner periphery 15, when considered from the perspective of traveling toward the center of the ring, with the sloping wall going up on its outer periphery being substantially longer with a more gradual slope than the sloping wall going down on its inner periphery. This makes for a gradual approach for the ball 20 in entering the ring 10, but, relatively speaking, a substantial obstacle in exiting from the ring.

It is noted that the thickness of the plastic ring 10 is, for example, 0.0625". Thicknesses for other compositions vary according to their individual properties and conformation.

Ringaround

The area immediately around the ring 10 —much like a "green" in golf —is termed a "ringaround". On maintained, grass courses, this area would be cut shorter than the fairway to facilitate the finishing chip.

Figure 2:
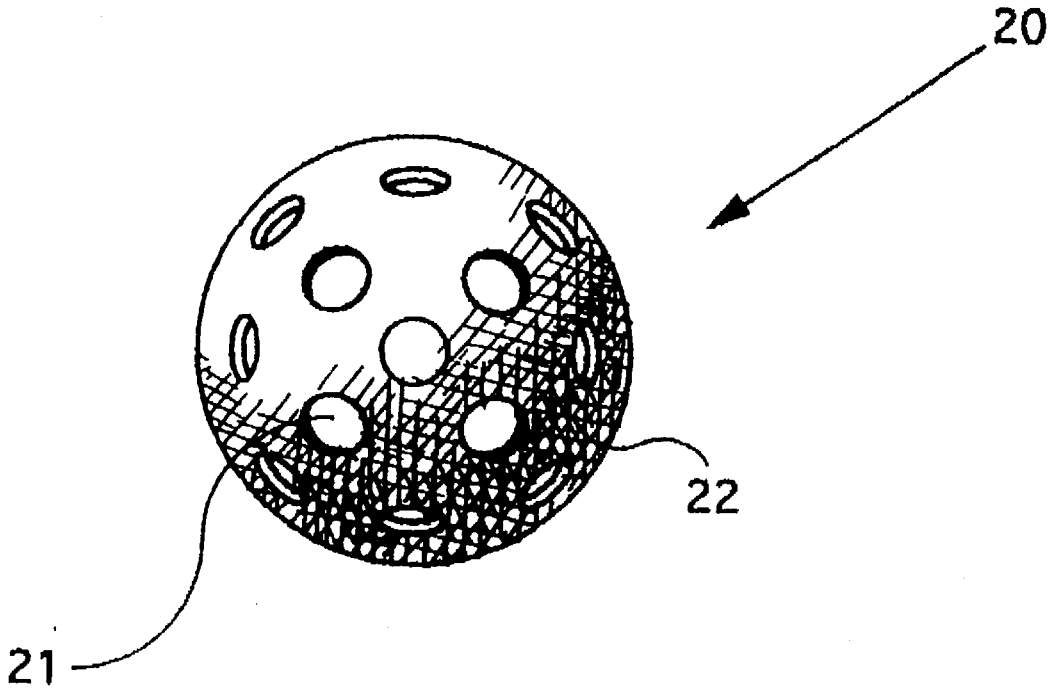
FIG. 2 is a direct view of an exemplary embodiment of a ball to be used in the preferred embodiment of the simulated golf game of the present invention.

Ball (FIG. 2)

The exemplary embodiment of the ball 20 to be used in the preferred, exemplary embodiment of the simulated golf game of the present invention has the following characteristics:

—a hollow, aerated, plastic ball 20, constructed of thin-wall, recyclable polyethylene (thickness: about 0.047"/1.119 mm);

—a size which conforms in size with the regulation golf ball (diameter: about 1.68 inch/4.267 cm); and —an impact factor in which the ball flies about fifty (50') feet when struck with a #9 golf club by an "expert" golfer in windless conditions, that is, the ball has a practical or effective "maximum" range of about fifty (50') feet. Such a ball is available as a hollow ball 20 having a series of spaced holes 21 in the peripheral surface of its thin, hemispherical, exterior surface wall 22, having a weight of about a tenth (0.1 oz) of an ounce.

For a full game pack, multiple balls 20 are provided of varying colors so that the players are less likely to confuse one player's ball with another player's ball.

It should be noted that retail/purchased balls vary in conformity, composition, design and material from store to store. This will significantly affect the distance the ball will fly and, thus, the layout area of the course of the invention.

Additionally, playing different types/makes of balls provide different approaches and experiences on the same course layout.

Additional exemplary "rules" or characteristics concerning the ball are:

—the ball 20 must come to rest within the ring 10 (FIGS. 1A & 1B) which simulates a golf course hole to complete the "hole";

—each player shall use the same ball 20 throughout the course of play; and

—all players shall use the same kind of ball, namely the same size, consistency, wall thickness, confirmation, etc., number of holes/perforations on surface, etc.

Figures 3A, 3B, 3C:
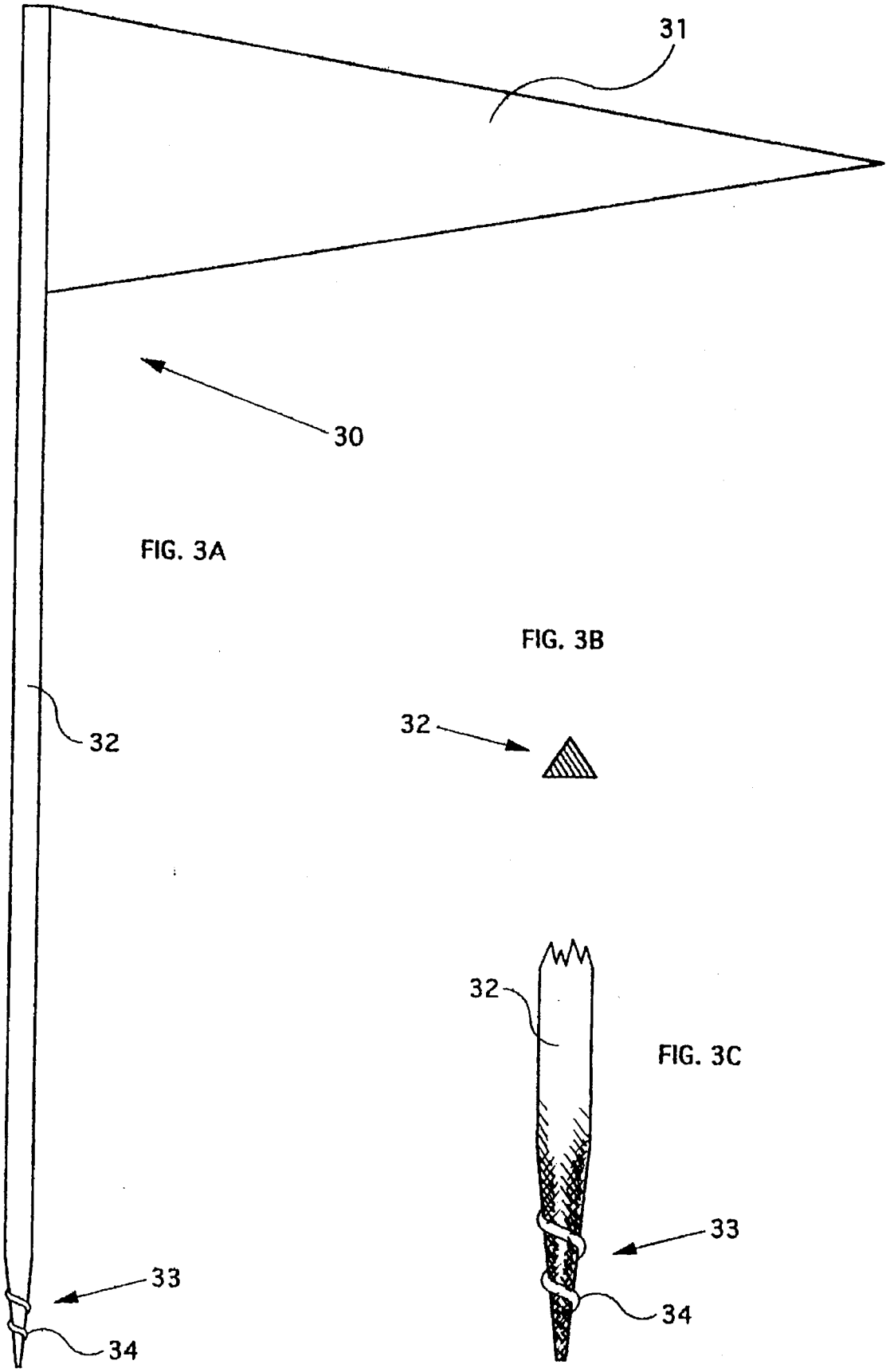
FIGS. 3A, 3B and 3C comprise a side view, a horizontal cross-section view and a close-up detail view, respectively, of the exemplary flagstick or flag-staff (with the latter view just showing the bottom, threaded tip of the shaft of the flagstick) used in association with the ring of FIGS. 1A & 1B in the exemplary embodiment of the simulated golf game of the present invention.

Flag (FIGS. 3A–C)

The game includes an appropriate series of flag-staffs 30, with each flag 31 [made of, for example, half (0.5 oz) ounce nylon] being preferably in pennant shape (having dimensions of, for example, 4"×12"×12"), with, e.g. a "GOLFIE"™ or other appropriate logo or name emblazoned on its display surface. The flag 31, illustrated in FIGS. 3A–3C, is mounted on a shaft 32 (having dimensions of, for example, 20" in height, which has a triangular cross-section (note FIG. 3B) and a tip 33 with threads 34 (note FIG. 3C).

Thus, as can be seen in the drawings (note also FIG. 7), the series of flags 30 associated with the rings 10 each including a flag 31 on a staff 32 which is supportable on the ground, one flag for each of said rings, with each flag staff being located for at least a period of time in the center area 11 of its associated ring, that is, it is positioned in the center of or in conjunction with or juxtaposition to the ring "hole" of FIGS. 1A & 1B.

The flag 31 preferably is color-coded to indicate the assigned "Par" of the "hole" being played (see also "TEEMARKER" of FIGS. 4A–4D), with the exemplary color-coding outlined below:

| | | |
|---|---|---|
| Colors: | Par 3 | Blue |
| | Par 4 | Red |
| | Par 5 | Yellow |

It is noted that, due to the condensed or reduced area used in a course of the invention, them sometimes could be confusion as to the par of the "hole" being played. To facilitate recognition of the "hole", a color scheme coordinating both the tee tassels 41 (FIGS. 4A–4D) and flags 31 (FIGS. 3A–3C) is effected as outlined above and below. This also aides the golfer in seeing the layout of the "hole" from the tee.

With respect to ancillary, exemplary rules for the flag-staff 30:

—it may be used as "stop" for the ball 20; and

—there is no penalty if a flag-staff 30 is hit by a ball 20.

Further exemplary details for the flagstick 30 are outlined below:

—plastic (polyethylene) shaft 32 (0.375" length for its triangular sides; 20" height);

—injection molded with screw tip 33 at bottom end;

—remains imbedded in ground in center of ring at all times (unless removed at option of player);

—may be used as "stop" for the ball 30;

—no penalty if flagstick 30 is hit by ball 20; and

—may be removed by player when hitting approach shot (no penalty).

The preferred layout of the course of the invention is decided upon by the "architect/designer" whose duty it is to delineate its layout and define its boundaries accurately to the players. "Hazards" and "out of bounds" are particularly important points to define.

Tee Marker (FIGS. 4A–4D)

An exemplary nine (9) tassels 41 (e.g. each 11" long ×0.25" wide) made of the same material as the flags 31 [e.g. a half (0.5) ounce, ripstop, nylon material (e.g. 100% "Dura-Lite" nylon)] is attached (glued/stapled/heat-fused) to the top of a plastic (e.g. polyethylene) shaft 42 (e.g. 0.375" length for its triangular sides; 20" in height).

The shaft 42 can be, for example, injection molded with screw or threaded tip 43 at its bottom end (note FIG. 4C) for ease in twistingly inserting the shaft into the ground and for enhanced gripping with the ground.

A tee marker 40 may be removed with no penalty if it interferes in any way with the player's swing and is to be replaced in the same position after the shot is executed. The tee marker 40 otherwise remains imbedded in ground at all times (unless removed at the option of player).

The tee markers 40 are also preferably color-coded to indicate the par of the "hole" being played (see "Flag" above), namely:

| | | |
|---|---|---|
| Colors: | Par 3 | Blue |
| | Par 4 | Red |
| | Par 5 | Yellow |

Course (FIG. 7)

An exemplary course layout for the game is illustrated in FIG. 7 and includes an exemplary three hole course having exemplary three par, four par and five par characteristics for the exemplary three holes.

The "3 par hole" layout 71 is laid out just over a hazard, which could, for example, be a creek, driveway or sidewalk, etc., designated by the architect/designer of the course. With a decent tee shot a short chip should give the player an opportunity to score a par or even a "birdie".

The "par 4 hole" layout 72 provides a dogleg left, designed to have the player hit the tee shot to the right of the tree, leaving a "fairway" approach shot to the ring 10 and the subsequent chip or pitch for par/"birdie".

The "par 5 hole" layout 73 provides a double dogleg left, wherein the player should hit the tee shot between the "creek" hazard on the left and the tall grass bunker on the right. The second "fairway" shot should land short of the hazard, leaving a short approach over the hazard to the "hole"-simulating ring 10.

Of course, this illustrated course is merely exemplary and subject to very great variation in design and layout.

"Frivolous" Rules

Since the raison d'etre for the game of the invention is fun for all, special consideration should be given to those less capable (either from lack of experience or ability) to keep the frustration level down and assure that they likewise have a good time. Toward this end the following, exemplary allowances can be made.

A. Hand-Aide

A player in dire straits (unable to advance the ball with the club) can pick up ball and throw it to the escape difficulty or to keep game moving.

B. Double Bogey Max

The maximum score awarded on a "hole" is a double bogey.

C. Whiffless

A "whiff" (missed ball) does not count as a stroke at any time during a round.

D. Two Bad Shots

After two bad shots or whiffs, a player can swing freely until s/he hits a shot s/he likes, without being assessed further strokes.

Ground Maintenance

Inasmuch as the game of the present invention is played in a relatively small space with players taking full golf swings, the ground can take an unusual amount of wear and tear. Therefore it is imperative that players use tees or tee pads and replace any divots taken in the course of play.

Handicapping by Club Selection

Regulation golf handicapping methods are applicable to the preferred embodiment of the invention as well. However, since the preferred embodiment has a "one club" limit, a unique handicapping option is to have the better player use a less advantageous club than the less capable player. This can be achieved, for example, by using the putter (the least effective club for "GOLFIE"™ play) against a higher handicapper's #8 or #9 iron.

Local Rules

The course architect/designer shall be responsible for the making of all local rules necessary to adapt the game of the invention to a course site. [See USGA Rules of Golf - Appendix 1: Local Rules]

One Club

A player shall select one club before the start of a round and use this same club throughout the course of play.

It is noted that, since only one club is allowed, a lofted club (e.g. 7, 8, 9 wedge) is preferable since it is easier to finish off the "hole" (with a pitch or chip) with such a club.

Multi-Club

While the preferred embodiment of the game is played most simply and easily with each player using only one club throughout the course of play (see "one-club" rule supra), players may select a "multi-club" option. As long as the number is commonly agreed upon by all before the start of play, players may use as many clubs as they choose (e.g. a driving club for tee shots, a mid-range club for approach shots, and a short iron for pitches and chips). However, it is noted that, due to the use of longer range clubs, a multiple club course tends to need more space for laying out the course.

Course (FIG. 7)

The layout of a particular course is decided upon by the "architect/designer" or assigned user whose duty it is to delineate its layout and define its boundaries accurately to the players. "Hazards" and "out of bounds" are particularly important points to define, and an exemplary course is illustrated in FIG. 7.

Ornamentals

Defined: Any plant so declared by course designer(s) to be of such beauty or delicacy that it should not be harmed in any way.

Relief From: Free drop; nearest relief, i.e., to point where one's swing will not in any way disturb/strike/harm the plant; no closer to the "hole".

Par

Par is the score that an expert golfer (the "golfer") would be expected to make for a given "hole". As in golf, the standard "holes" in the preferred embodiment of the invention have pars of "3", "4" & "5" strokes, or even par "2" if so desired. Distances for guidance in computing par (exemplary ones are given below) are not absolute, because allowances should be made for the configuration of the ground, any difficult or unusual conditions and the severity of the hazards. (See USGA "Rules of Golf")

| | |
|---|---|
| Par 2 | up to about 35 feet |
| Par 3 | up to about 70 feet |
| Par 4 | about 71 feet to 130 feet |
| Par 5 | about 131 feet and over |
| Par 6+ | one particular feature of the preferred embodiment is that of being able to lay out "holes" of whatever length the "architect/designer" deems suitable. |

It should be noted that all "holes" are based on the average distance [about (50') feet] that the preferred embodiment type ball travels when struck by an expert golfer with a #9 iron in windless conditions. These distances are not absolute and should be used to serve as guidelines.

Preservation of a Course Site & Environmental Concerns

Since the game of the invention preferably utilizes a relatively small area, particular attention must be paid to the environment in which it is played. Preservation of the course site is facilitated by defining areas, including ornamental plants or cultivated grounds, as "ground under repair" from which play is prohibited.

Teeing" relief is mandatory on lawns and other attended pieces of land:

—Do not litter; and

—Pick up tees (especially broken ones).

Scoring

The scoring preferably is the same as in regulation golf, namely:

| | |
|---|---|
| Double Eagle | 3 under Par |
| Eagle | 2 under Par |
| Birdie | 1 under Par |
| Par | Expected score by expert golfer. |
| Bogey | 1 over Par |
| Multiple Bogey (double-, triple-, etc.) | |

Also in the preferred embodiment of the game of the invention:

| | |
|---|---|
| Duckie | Non-score given when, upon completion of the "hole", so much fun was had by player that score is irrelevant - or forgotten. |
| Miracle | Score less than Double Eagle! (usually with major wind assist) |

Teeing Area

The teeing area shall be defined as a box/rectangle drawn one club length either side of a single tee marker (no closer to the "hole") and one club length deep (away from the "hole").

It is noted that, in the basic rules as set out by the Honorable Company of Edinburgh Golfers (predecessors of The Royal and Ancient Golf Club), the first rule states that "You must tee your ball within a club length of the tee marker".

When using two (2) tee markers to define one teeing area, the rectangular area as deemed in The USGA Rules of golf applies.

There can be two or more teeing areas in the same vicinity for play to a single "hole" (ring) for different approaches, looks or angles to the "hole".

Teeing Pad

A teeing pad placed at a tee can be used without penalty. This is particularly useful to keep a frequently used teeing area (as in a set course in one's yard) from being dug up by the divot-taking of tee shots. The pads can be small pieces of artificial turf, rug remnants, etc.

Teeing Relief

Through the "Green": A player shall be allowed to tee up his/her ball within two (2) clubhead-lengths (6 in.) of the lie at any place on the course. (See "Preferred Lie" rule in USGA Rules of Golf.) This Rule can be made mandatory where preservation of the terrain is expressly desired (e.g. —private yards, parks, etc.).

On the "Green" (Ringaround): Within one club length (3 ft.) of the ring, the relief shall be no closer to the "hole" (ring).

TYPES OF PLAY IN THE INVENTION

It is noted that handicaps, as figured in the preferred embodiment of the invention or USGA Rules of Golf, can be used.

Double Play

Play two (2) balls concurrently in a round.

Nine (9) holes become eighteen (18) with little more time spent playing. This is particularly convenient for a single player to play more holes in about same amount of time.

Two (2) or more players need to mark (keep track of) the balls.

Individual Scramble

Play like individual "scramble" wherein the player hits two (2) shots from each position and chooses/selects the better ball to play.

Invent-A-Hole

Winner of previous hole decides which hole to go to next and from where.

—no set course layout progression;

—play from any tee to any "green" (ring);

—"one-hole-at-a-time" match;

—9, 18 or a mutually agreed upon number of holes; and

—scorer keeps track of holes as they are played.

"Mulligan"

A player can hit a "Mulligan" (extra shot) anytime during a round and count it instead of the original shot.

Random Play

Once a ring is set in a playable spot, the player can use any line of approach to play to any "hole". When only one group is playing, any "hole" on the course can be next, as long as all players in group know and agree. The players follows normal course layout progression and play established (laid out) "holes" in random order.

Sailing Play

Take ring and "sail" (throw like a "frisbee") it before you. Then play to it from where you are. This is fun to do on walk in park, countryside or beach.

Wing-It "Hole"

No set par. Just tee it up and play to any "hole" from anywhere (as long as it is an even proposition, with no advantage given or gained by one player/opponent over another). This can be match or medal competition.

Other-Handed Play

Players play against each other from opposite side than they normally play (right-handers swing left-handed and vice versa) but all players in group must mutually agree.

This can also be used as a method of handicapping, player(s) of superior ability, who can play "other-handed" to give less capable player(s) a better chance. This is actually beneficial to overall capability of player since there occasionally arise in the course of play, situations where the ball is laying in such a position that with a normal swing it is impossible to advance the ball. The infrequency of such a predicament leads to little or no practice by an average player, and therefore this would be ultimately beneficial to overall ability of player.

Night Play

Since the relatively light, exemplary ball does not go very far, the slightest bit of light (from moon light, street light, porch, house, cars, flashlights, etc.) is needed to hit the ball - and find it.

A lost ball means a lost match, and a player hits the ball as far as s/he dares.

One-For-All

All players use the same (or similar) club throughout the round. The selection of the club to be used shall be determined by consensus (i.e. through mutual agreement, drawing lots, coin flip, etc.).

If playing out of one set of clubs, a club (e.g. - #9 iron) is selected and all players use this same club for all their shots. If multiple sets of clubs are available, all players must use similarly lofted and/or numbered clubs (e.g. - all use #9 iron).

It is noted that this game allows players to see how they fare with each other - and the course - using the same club.

Pitch &Chip

Players use a regulation golf ball to pitch and/or chip around the exemplary, preferred course of the invention, such as the one laid out in FIG. 7. To finish off a "hole", the ball 20 needs to land within the ring 10 on the fly (rather than coming to rest within the ring as in the regular play of the game of the present invention).

The ball 20 can wind up anywhere as long as it flew into the ring 10.

Par would generally be two (2), since a golf ball can easily be hit to any hole from the tee.

As in the regular playing of the simulated game, the player must same club throughout the round.

It is noted that this is a excellent way to practice for real golf since the best method in pitching and chipping is to hit to a spot.

Bump and Run

As in "Pitch & Chip" supra, a regulation golf ball is used to pitch and/or chip around the course of the invention. However, in this aspect of the game, the golf ball must bounce at least once outside of the ring before coming to rest within the ring as in the regular play of the simulated golf game.

Par would generally be two (2) since a golf ball can easily be hit to any hole from the tee.

As in regular play, the player must use the same club throughout the round.

It is noted that this game is particularly effective for practicing shots.

PACKAGING & STORAGE BOX (FIGS. 5 & 6)

A preferred, exemplary boxing system, which is part of the present invention and is for the simulated golf game described above, is illustrated in detail in FIGS. 5 & 6.

As can be seen in these drawings, the packaging and storage container for the elements of the golf simulation game includes an outer, rectangular box 50 with a foldable top 51A and bottom 51B and a carrying handle 52 having inner, divided portions formed by an inserted divider 60. The divider 60 divides the inner area of the box into five areas —four, triangularly-shaped, corner areas 56A–D and a central, eight-sided, open area 56E of substantially larger size than said four corner areas. As can be seen in the drawings, the eight sides of the central area 56E are straight and nearly equal in length.

Exemplary, overall dimensions for the box 50 are a twenty and a half (20.5") inch square box three (3") inches deep. The two, upper, side compartments 56A & B each have equal, six and a half (6.5") inch exterior sides 53, while the two, lower, side compartments 56C & D have equal, five (5") inch exterior sides 54, while the partial side 55 between the two, upper, corner areas is seven and a half (7.5") inches and the partial side 57 between the two, lower, corner areas 56C & D is ten and a half (10.5") inches long. The two, opposed, partial sides 58 separating the upper and lower corner areas 56A–56D from each other are nine (9") inches in length.

When the packaging 50/60 and game elements 10–40 are combined, the series of individual, spaced, "hole"-simulating rings 10 are nested or stacked together, one on top of the other, and located in the central open area 56E, while a multiple number of balls 20 are located in at least one of the corner areas, with two (56A & 56B) being so occupied in the exemplary embodiment illustrated. The other two, lower, corner areas 56C & 56D are separately occupied by tees and pencils, respectively, with the latter being used to keep track of the game's scores.

Figure 6A:
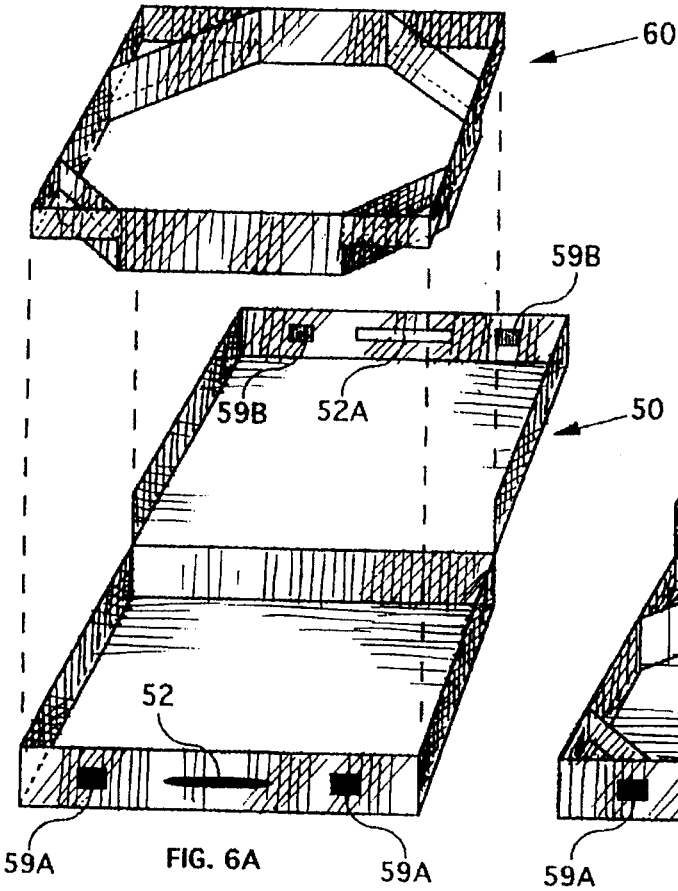
Figure 6B:
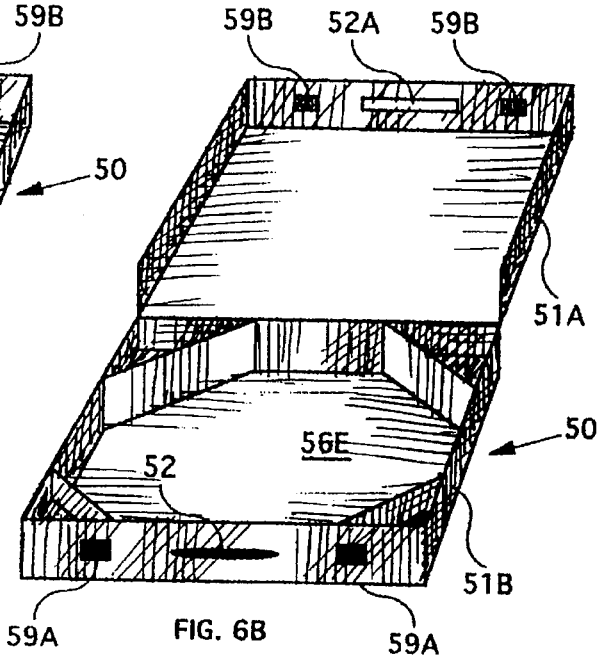
Figure 6D:
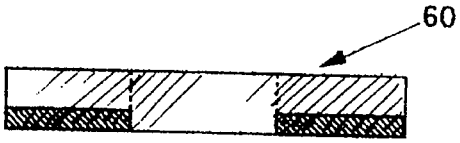
FIGS. 6D, 6E and 6F are back, side and front views, respectively, of the assembled box.
Figure 6E:
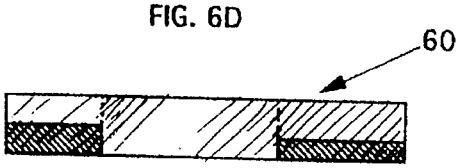
Figure 6F:
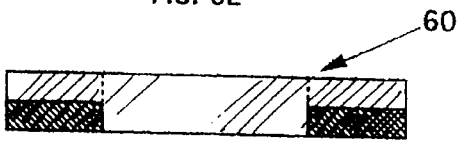
Figure 6C:
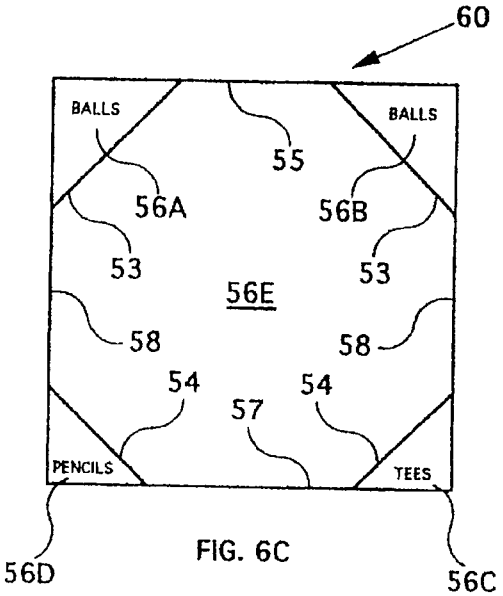

"Velcro" type of fastening preferably is used to maintain the box 50 closed and yet allow easy opening of the box by the user, when so desired. With particular reference to FIG. 6B, a flanking pair of "loop" swatches 59A are located on either side of the handle 52 on the exterior side of the bottom, front box panel, while a like positioned pair of "hook" swatches are located on the interior side of the top, front box panel on opposite sides of the handle opening 52A.

When it is desired to close the box 50, the top 51A is pulled down over the bottom 51B, with the handle 52 exposed through the handle slot 52A. By applying slight pressure inwardly against the front box panel, the opposed "hook and loop" swatches 59A/59B become inter-engaged, effectively "locking" the top 51A to the bottom 51B for secure transportation of the boxed game when, for example, the box is being carried by the handle 52. To open the box 50 the process is basically reversed.

The box container 50/60 would also include the "Rules of GOLFIE™", The USGA Rules of Golf, and an informational booklet on the designing and laying out of appropriate courses.

The material for the outer, rectangular box 50 can be corrugated plastic or plastic-coated paper product, while the box insert 60 can be made of recycled/recyclable thermoplastic material, vacuum-molded. Of course, many other suitable materials alternatively could be used.

* * *

It is noted that "ground" as used herein means any support surface suitable for playing a game like that described above, including literally ground, artificial "turf", etc., whether indoors or out. It is also noted that the term "GOLFIE™" is sometimes used herein, and such use is generally intended to refer to the underlying game of the invention described above and not to any particular trademark. It is also noted that the use of the terms "maximum" and "minimum" as used in connection with the spacing distances between the starting tee and its respective "hole"-simulating ramp ring, or the "maximum" range of the ball, are relative terms, related, for example, to a theoretical expert golfer using a #9 iron, and are subject to some variation. Additionally, in measuring the distance between the tee and its respective ramp ring, the distance is measured based on the expected path of the ball, and not necessarily along a single, straight line or "as the crow files."

While the present invention has been shown and described in what is at this time currently believed to be most the practical and preferred embodiment, it should be understood that departures may be made therefrom within the scope of the invention, which therefore is not to be limited to the details disclosed herein, but it is to be accorded the full scope of the claims, including the embracing of any and all equivalent devices and approaches.

Thus, it is noted that the embodiment described herein in detail for exemplary purposes is subject to many different variations in structure, design, application and methodology.

Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

We claim:

1. A simulated game of golf, comprising:

a simulated golf course, including a sequential series of at least three, individual, spaced, "hole"-simulating rings with open centers placed upon the ground and an associated series of tee markers, each ring being spaced from an associated one of said series of said tee markers by at least about a minimum of thirty-five (35') feet, with at least two of the three separation distances between one of said rings and its respective tee marker being equivalent to at least two different pars from a selection of a par "3", par "4" or par "5" separation distance, with a par stoke considered to be about fifty (50') feet in distance;

at least one ball substantially lighter than a regulation golf ball having a maximum effective range of about fifty (50') feet due to its size, weight and configuration when hit by a ball striker club similar in size and configuration to a regulation golf club and a diameter substantially less than the diameter of the open centers of said rings; and at least one ball striker club similar in size and configuration to a regulation golf club and suitable for hitting at least one of said balls placed on the ground to go an effective maximum range of about fifty (50') feet due to said striker club's own weight and configuration and the size, weight and configuration of said one of said balls.

2. The simulated golf game of claim 1, wherein there is further included:

an associated series of miniaturized flag devices, each flag device including a flag on a staff which is supportable on the ground, one flag device for each of said rings, each said flag staff being located for at least a period of time in the center area of its associated ring.

3. The simulated golf game of claim 2, wherein:

said flag devices are color coded to indicate the "par" of that particular simulated "hole" and having a height of about twenty (20") inches.

4. The simulated golf game of claim 1, wherein:

each of said balls comprises an aerated, hollow, plastic ball with a weight of about a tenth (0.1 oz) of an ounce.

5. The simulated golf game of claim 1, wherein:

each of said rings has an outer diameter of about twenty (20") inches and an inner diameter of about fifteen (15") inches.

6. The simulated golf game of claim 1, wherein:

each of said rings has an inner periphery and an outer periphery and is circular and has a sloping wall going up on its outer periphery and a sloping wall going down on its inner periphery when considered from the perspective of traveling toward the center of the ring.

7. The simulated golf game of claim 6, wherein:

the sloping wall going up on its outer periphery is substantially longer with a more gradual slope than the sloping wall going down on its inner periphery.

8. The simulated golf game of claim 7, wherein:

the sloping wall going up on its inner periphery is less than one inch in its effective length, while the sloping wall going down on its outer periphery is about two inches in its effective length.

9. The simulated golf game of claim 1, wherein:

a series of color-coded flags are provided and positioned in juxtaposition to said rings, one for each of said rings, with the color being coded to the par value assigned to that "hole".

10. A combined storage box and elements for playing a simulated game of golf, comprising:

a rectangular box having inner divider portions dividing the inner area of the box into five areas —four corner areas and a central, open area of substantially larger size than said four corner areas;

a series of individual, spaced, "hole" simulating rings having a size greater than said central, open area of said box and having open center areas nested together one on top of the other located and stored in said central open area; and a multiple number of balls, each being substantially lighter than a regulation golf ball and having a diameter substantially less than the diameter of the open centers of each one of said rings and less than the size in both the horizontal and vertical dimensions of at least one of said corner areas, located and stored in at least one of said corner areas of which each said balls is smaller.

11. The combined storage box of claim 10, wherein there is further included:

an associated series of tee devices upon which said balls can be placed for hitting an individual ball with a club, located in a corner area different from the one(s) in which said balls are located.

12. The combined storage box of claim 10, wherein:

said corner areas are triangular in shape and said central, open area has eight, straight sides.

13. The combined storage box of claim 12, wherein:

said divider portions are formed by one, single, integral, insert member placed within a rectangular, outer box.

14. A method of simulating the game of golf, comprising the following steps:

providing the course for play in the form of a sequential series of at least three, individual, spaced, "hole"-simulating rings with open centers placed upon the ground and an associated series of tee markers, each of said rings being spaced from an associated one of said series of said tee markers by at least about a minimum of thirty-five (35') feet, with at least two of the three separation distances between one of said rings and its respective tee marker being equivalent to at least two different pars from a selection of a par "3", par "4" or par "5" separation distance, with a par stoke considered to be about fifty (50') feet in distance;

using at least one ball substantially lighter than a regulation golf ball having a maximum effective range of about fifty (50') feet due to its size, weight and configuration when hit by a ball striker club similar in size and configuration to a regulation golf club and a diameter substantially less than the diameter of the open centers of said rings; and using at least one ball striker club similar in size and configuration to a regulation golf club and suitable for hitting at least one of said balls placed on the ground to go an effective maximum range of about fifty (50') feet, due to said striker club's own weight and configuration and the size, weight and configuration of said ball, and using a full golf swing in hitting the ball toward a selected ring, causing the ball to be airborne for most of its travel.

* * * * *